US005219423A

United States Patent [19]

Kamaya

[11] Patent Number: 5,219,423

[45] Date of Patent: Jun. 15, 1993

[54] CARRYING SYSTEM

[75] Inventor: Naoki Kamaya, Tokyo, Japan

[73] Assignee: Sony Corporation, Japan

[21] Appl. No.: 794,880

[22] Filed: Nov. 20, 1991

[30] Foreign Application Priority Data

Nov. 30, 1990 [JP] Japan ..... 2-339841

[51] Int. Cl.[5] ..... A45C 11/38

[52] U.S. Cl. ..... 224/151; 224/202; 224/205; 190/108; 190/903; 24/633

[58] Field of Search ..... 224/151, 202, 205; 190/108, 903; 24/633

[56] References Cited

U.S. PATENT DOCUMENTS

| | | | |
|---|---|---|---|
| 3,572,560 | 3/1971 | Dolph | 224/202 |
| 4,424,841 | 1/1984 | Smith | 224/151 X |
| 4,431,041 | 2/1984 | Leiserson | 190/102 X |
| 4,620,579 | 11/1986 | Lowe et al. | 190/110 X |
| 4,673,070 | 6/1987 | Ambal | 190/108 |
| 4,727,630 | 3/1988 | Alan | 24/633 X |
| 4,744,446 | 5/1988 | Arney | 190/108 |
| 4,842,032 | 6/1989 | Mastronardo | 190/903 X |

FOREIGN PATENT DOCUMENTS

| | | | |
|---|---|---|---|
| 2236475 | 4/1991 | United Kingdom | 190/108 |

*Primary Examiner*—Allan N. Shoap
*Assistant Examiner*—Paul A. Schwarz
*Attorney, Agent, or Firm*—Ronald P. Kananen

[57] ABSTRACT

A carrying system which may be utilized for carrying video cameras and accessories therefor comprises a main case and a plurality of accessory cases which interlock for carrying as a single unit. The main case includes clasps for releasably engaging linking straps which are provided on the accessory case for locking the accessory case to the main case. The accessory case is provided with, in addition to the linking straps, clasps like those on the main case so that a plurality of accessory cases may be joined together. Further, slots are provided on a portion of the accessory case such that free ends of the linking straps may be retained when the accessory case is carried alone, and so that the accessory case may be looped through the belt, or shoulder strap of a user for convenient carrying.

23 Claims, 5 Drawing Sheets

CARRYING SYSTEM

BACKGROUND OF THE INVENTION

1. Field of The Invention

The present invention relates generally to a carrying system. Particularly, the present invention relates to a carrying system for carrying cameras and camera accessories or the like, in which various items may be carried separately and conveniently in a plurality of carrying cases.

2. Description of The Background Art

A variety of types of carrying bags for carrying video cameras and accessories therefor are well known as well as various carrying cases for carrying miscellaneous items. One such proposed carrying bag has been disclosed in Japanese Unexamined First Publication Patent Application (Showa) 64-37353, assigned to the present applicant, which teaches a trunk formed suitably for the storage of a video camera with a case formed therein for storage of accessories.

Another such conventional carrying bag has been disclosed in Japanese Laid-Open Utility Model Publication (Showa) 61-190223, which teaches a carrying bag for a video camera only.

The above mentioned carrying bags have a drawback in that a camera may be carried but additional items must be carried separately, or that all items to be carried must be carried in the same bag.

Another carrying bag has been proposed in Japanese Patent Application 1-262762, assigned to the present applicant, which discloses a carrying system for a camera and related accessories consisting of a first bag, for carrying a camera, and a second bag, for carrying accessories. The two bags may be stackably linked for carrying as one unit.

The drawback to the above described carrying system is that if one bag is used to carry a video camera, for example, and the second bag is used for a battery charger, there is no more space for carrying tape cassettes, additional lenses, cables or other necessary accessories. Further, if for example, all accessories are packed into the second bag it becomes heavy and disorganized as personal items such as a wallet, map, identification etc. must be packed in with the camera accessories. This means that unnecessary, items cannot easily be separated from necessary ones. For example, a battery charger, necessary for many portable video cameras, is heavy and, if it must be carried together with other components, causes the carrying bag to become large and heavy and reduces portability. For a short excursion it may be convenient to leave the charger behind, or to have it carried separately by another person. This cannot be conveniently accomplished with conventional carrying systems.

SUMMARY OF THE INVENTION

It is therefore a principal object of the present invention to provide a carrying system in which a variety of items may be kept in separate encasements which may be easily joined for convenient carrying.

It is a further object of the present invention to provide a carrying system for video cameras and accessories therefor in which separate components may be discretely stored and which can be conveniently carried as a unit or may be separated to be carried or stored separately.

In order to accomplish the aforementioned and other objects, a carrying system for articles comprises: a main carrying case; a plurality of accessory cases; releasable locking means attached at corresponding positions on each of the main carrying case and the accessory cases; linking means, engageable with the releasable locking means and associated with the releasable locking means of each accessory case so as to extend vertically upward from a mounting position of the releasable locking means of the accessory cases.

According to another aspect of the present invention, a carrying system for a video camera and accessories therefore comprises: a main camera case engageable with an accessory case; a first accessory case engageable with the main camera case and/or another accessory case; a second accessory case engageable with the main camera case and/or the first accessory case; releasable locking means attached at corresponding positions on each of the main carrying case and the first and second accessory cases for effecting the engagement; linking means, engageable with the releasable locking means and associated with the releasable locking means of the first and second accessory cases so as to extend vertically upward from a mounting position of the releasable locking means of the first and second accessory cases.

In either of the carrying systems set forth above, the linking means may comprise a linking strap with ratchet teeth formed on a surface thereof, further to say the releasable locking means may be molded as a single piece to engages the ratchet teeth formed on the linking strap.

The releasable locking means of the invention is provided with a displacable portion, a biasing portion, an engaging portion associated with the biasing portion, and an opening therethrough. Displacement of the displacable portion causes movement of the biasing and engaging portions against the direction in which the biasing portion is biased, this condition allowing the introduction of the linking strap via the opening.

Further, in the carrying systems as set forth above, the dimensions of top and bottom portions of each of the plurality of accessory cases may be the same as a dimension of a bottom portion of the main case and each of the accessory cases may be provided with a zipper at an outer peripheral portion thereof.

According to the above described carrying systems, the accessory cases may be made to be identical, or alternatively, different accessory cases may be compartmentalized differently for holding specific accessories.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Figure 1:
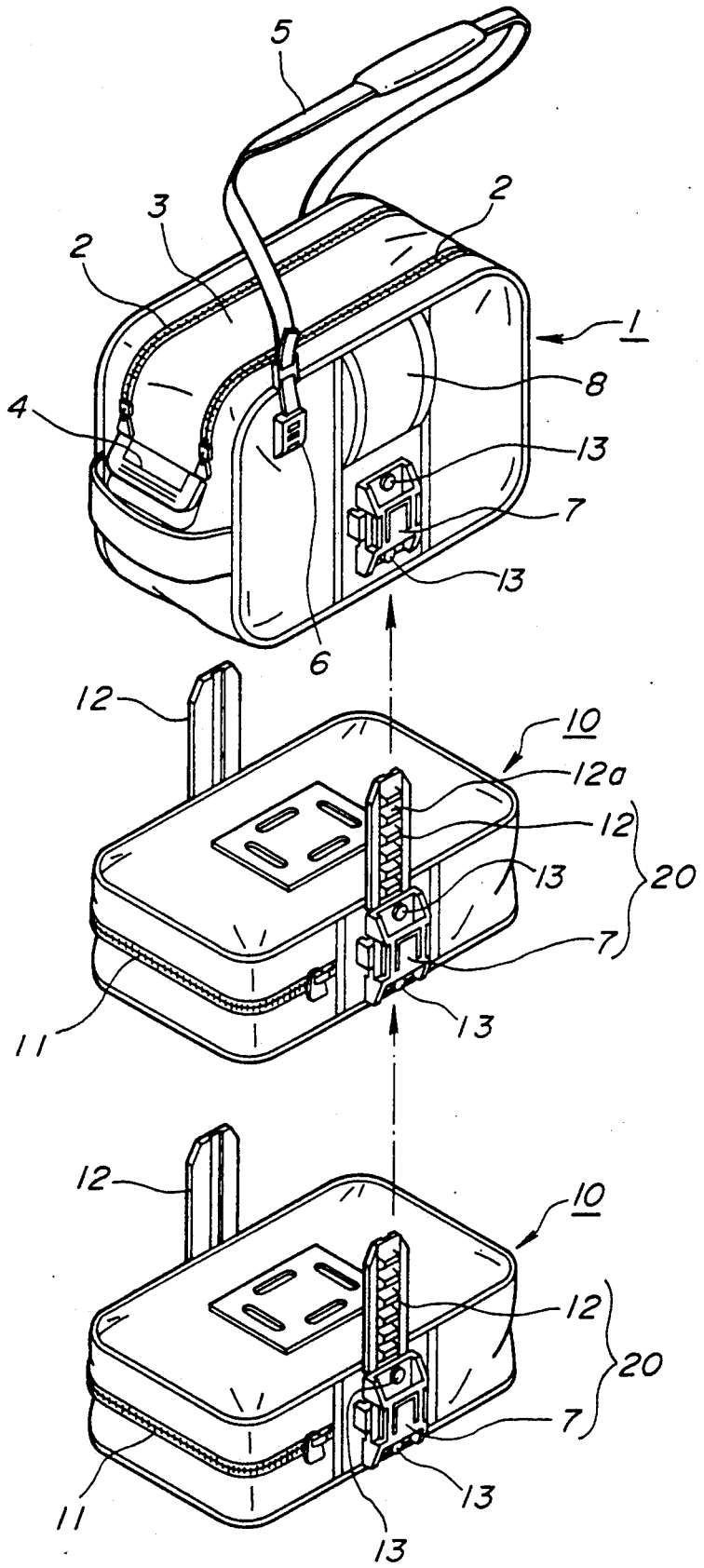
FIG. 1, shows a perspective view of the carrying system of the invention separated into individual components.
Figure 2:
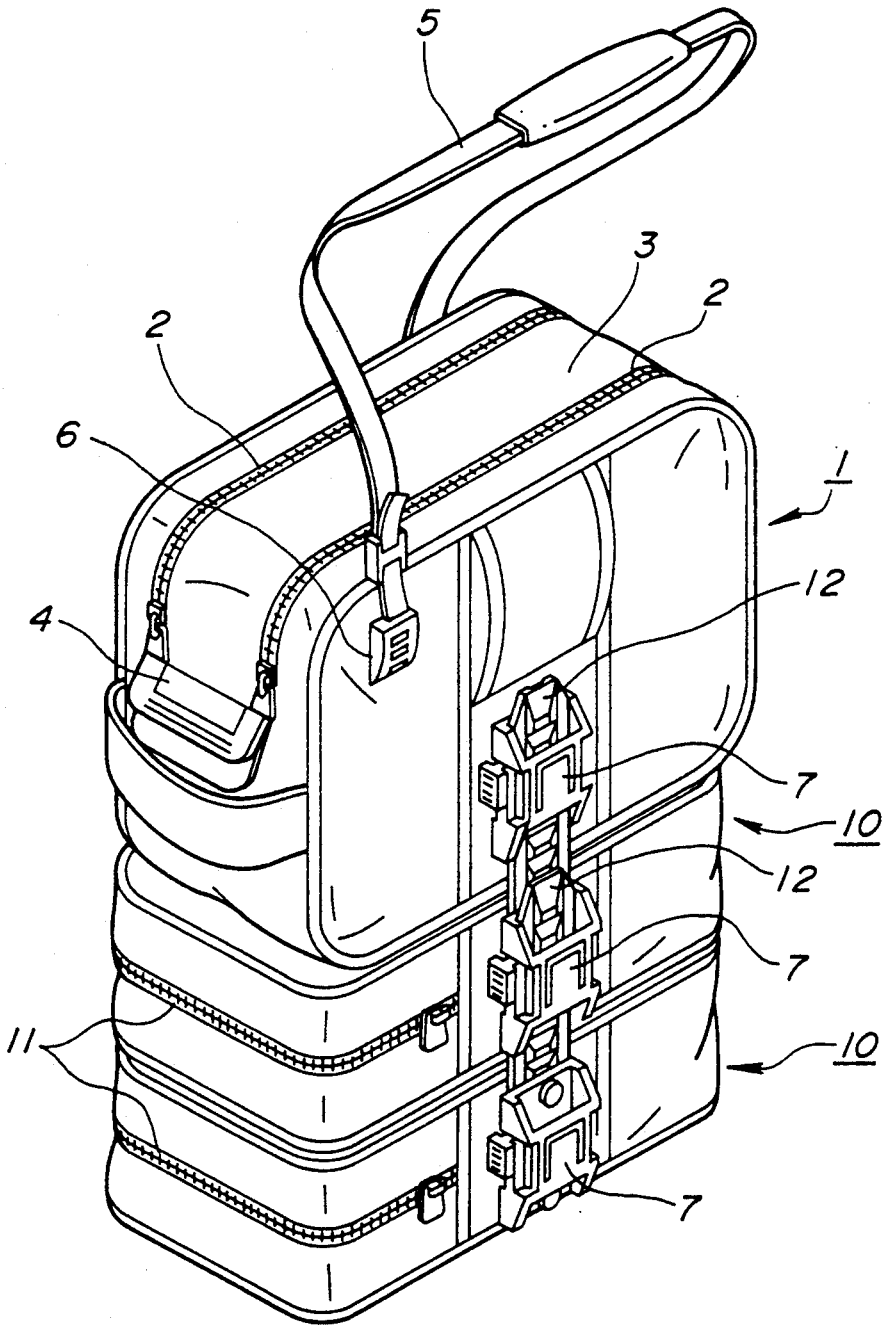
FIG. 2, shows the carrying system of FIG. 1, with the components joined together for carrying as a single unit.

Referring now to the drawings, particularly to FIG. 1, the carrying system of the invention consists of a main (i.e. camera) case 1, and a plurality of accessory (attached) cases 10 which are joined by way of a linking clasp 7.

As can be seen in FIG. 1, the main case 1 is of a simple, substantially rectangular, shape. On an upper side of the left and right longitudinal sides of the main case 1 zippers 2, for example, are affixed respectively. Between, and engaging with, the zippers 2, an upper flap 3 is provided. Both zippers 2 are attached to a single handle 4 which acts so as a bridge between the zippers 2. The handle may be made of plastic, for example, and allows both zippers 2 to be easily pulled together, back and forth, to open and close the upper flap 3.

At an upper corner of each of the side portions of the main case 1 a shoulder strap 5 is attached via a strap retainer 6 which is attached to side portions of the main case 1. In the present embodiment, two strap retainers are provided on upper corners of longitudinal side portions of the main case 1, diametrically opposed relative the upper flap 6.

Further to say, the main case 1 may be conveniently attached, to an accessory case 10 via linking straps 12 provided on opposing sides of the accessory case 10 and linking clasps 7 provided at a corresponding location on the main case 1 as will be described in detail hereinlater.

In FIG. 1 it can be seen that the accessory case 10 is also of a simple, substantially rectangular design. The upper and lower edges of the accessory case 10 may be formed so as to conform substantially to the dimensions of the bottom of the main case 1. Further, the accessory case is provided with a zipper 11, for example, on a circumferential side portion thereof for allowing items to be easily taken in or out of the accessory case 10.

On both sides of the accessory case 10, two flexible linking straps 12 are provided. The linking straps 12, which may be of molded rubber, plastic or other suitable material, are oriented such that one end is securely fastened to a side of the accessory case and a free end of the linking strap 12 extends in an upward direction for engaging with a linking clasp 7 attached to the main case 1. Further, the accessory case 10 is also provided on each side thereof with a linking clasp 7 which is mounted over the fixed end of the linking strap 12. In the case of the accessory case 10, the linking clasp may be attached by means of fasteners 13 which pass through a mounting portion of the clasp, as well as through the end of the linking strap to be fixed so as to secure the linking strap as well. This combination of linking clasp 7, linking strap 12, and fasteners 13 is indicated in FIG. 1 as a linking assembly 20.

The linking strap 12 is provided with ratchet teeth 12*a* on an outward facing portion thereof allowing the accessory case 10 to be securely attached to the main case 1 or to another accessory case 10. Hereinafter the structure and operation of the linking strap 12 and the linking clasp 7 will be explained.

Figure 4A:
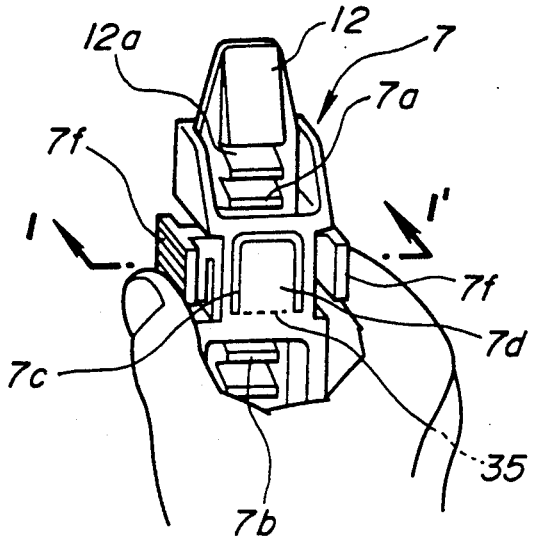
FIG. 4, A and B are perspective views of a releasable linking clasp of the invention and the construction thereof.

First of all, referring to FIG. 4A, the body of the linking clasp 7 may be formed of a single piece of synthetic resin, for example, by a moulding process or the like. The linking clasp 7 is provided on opposing sides thereof with strap guide portions 7*a* and 7*b* respectively. a cut-out groove 7*c* is formed in a central part of the clasp which defines a biased portion 7*d* which is movable relative an edge portion 35 thereof which is attached to the main body of the linking clasp 7.

Figure 4B:
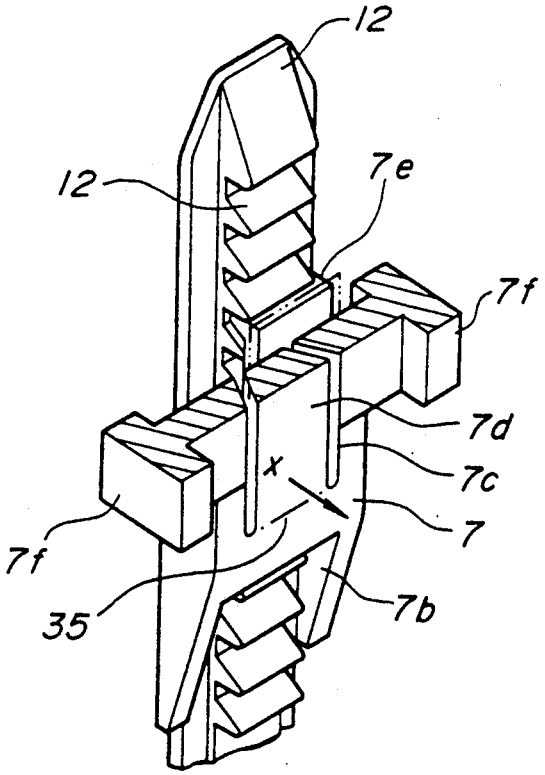

FIG. 4B shows an oblique view of the linking clasp 7 from which a front portion has been removed along a line A—A' of FIG. 4A, to more clearly show the structure and functioning of the linking clasp 7.

In FIG. 4B, in which the upper edge of the groove 7*c* is cut away, it can be seen that an engaging portion 7*e* is formed on a lower area of the biased portion 7*d*. This engaging portion 7*e* allows an accessory case 10 to be securely attached to the main case, or another accessory case, via the ratchet teeth 12*a* on the linking strap 12. The linking clasp is formed with push members 7*f*, 7*f*, on both sides of the biased portion 7*d*. Simultaneously pushing the push members 7*f*, 7*f* toward each other causes the biased member 7*d*, supported by the flexible edge portion 35, to move against its biased direction, that is, in a direction away from the linking strap 12, the direction of the arrow x in FIG. 4B.

The cooperation of the above elements to form a releasable clasp mechanism will be explained with reference to FIGS. 5A and 5B.

The groove 7*c* which defines the biased portion 7*d* is formed at an angle. That is, the groove 7*c* separates the biased portion 7*d* from the push members 7*f*, 7*f* at either side thereof. The groove 7*c* is such that tapered side portions 36 are formed on the sides of the biased portion 7*d*, with a reciprocal taper being present on the inner surfaces 37 of the push members 7*f*, 7*f*. The tapered surfaces 36 and 37 being thus arranged in opposing fashion.

Figure 5A:
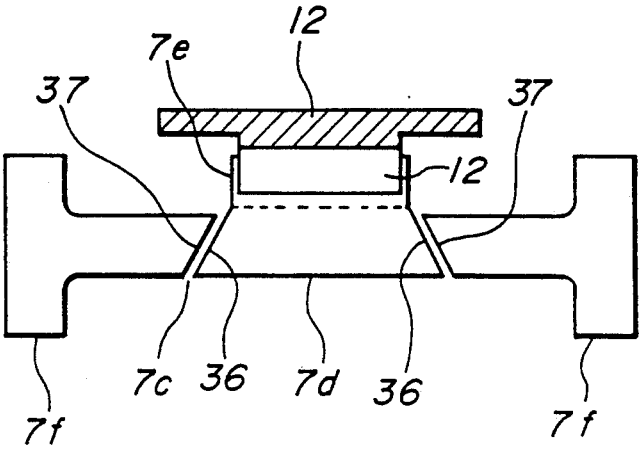
FIGS. 5A and B show the releasable linking clasp of the invention in cross section.
Figure 5B:
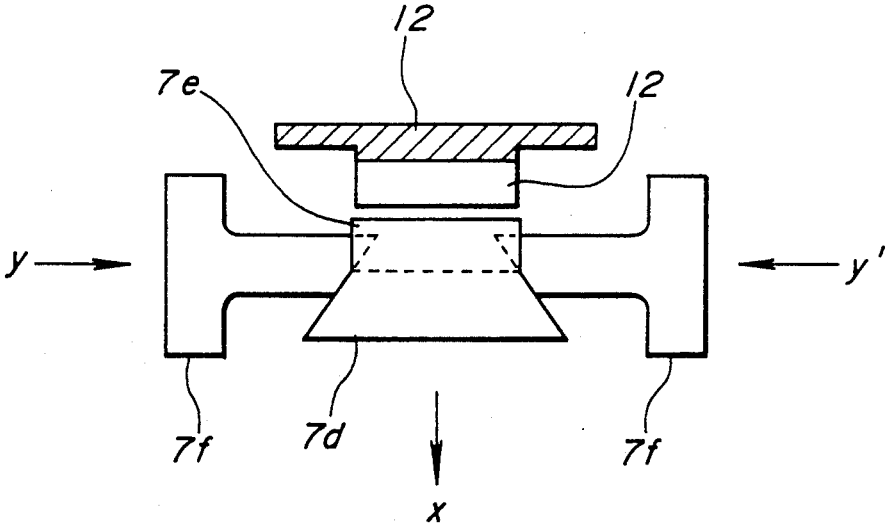

FIG. 5A shows the linking strap 12 with ratchet teeth 12*a*, the biased portion 7*d*, including the engaging member 7*e* in a locked arrangement. As seen in FIG. 5B, from this condition, by pushing the push members 7*f*, 7*f* toward each other, in the direction shown by arrows Y, Y' in FIG. 5B, the tapered surfaces 37, 37 of the push members 7*f*, apply pressure to the tapered surfaces 36, 36 of the biased portion 7*d*, causing the biased portion 7*d* to move in a direction away from the linking strap 12, that is, in the direction of the arrow x in FIG. 5B. This causes the engaging member 7*e* to become disengaged from the ratchet teeth 12*a* of the linking strap 12 and an unlocked condition is assumed.

Thus, with the linking clasp and strap arrangement disclosed herein, a main case 1 and an accessory case 10, for example, may be easily and securely joined. When the push members 7*f*, 7*f* are held in the pushed in position, as shown in FIG. 5B, a linking strap 12 of an associated case may be easily inserted through the strap guide openings 7*a* and 7*b*, to be pulled therethrough until a snug fit is obtained. That is, the left side, upward projecting, linking strap 12 of an accessory case 10 may be inserted into the lower strap guide portion, 7*b* for example, of the left side linking clasp 7 of a main case 1, while the push members 7*b*, 7*b* of the linking clasp 7 are held in their pushed in position. The linking strap is inserted until its free end exits through the uppers strap guide portion 7*a*, for example and, when the linking strap 12 of the accessory case 10 is sufficiently inserted through the strap guide portions 7*a*, 7*b*, the push members 7*f*, 7*f* are released to assume their original pushed out positions (i.e. FIG. 5A) according to the downward pressure exerted by the biased portion *7d*. When the biased portion *7d* moves downward, the engaging member *7e*, formed at a lower side of the biased portion, engages at least one of the outward facing ratchet teeth 12*a* of the linking strap thus locking the clasp and linking strap securely together. The above operation is carried out for each corresponding linking clasp and linking strap of the cases to be joined. Thus two or more cases may be easily and securely attached to each other for convenient carrying as a single unit, or easily detached, by pushing and holding in the push members *7f*, *7f*, for separate storage or carrying.

Moreover, according to the arrangement of the linking assembly 20 provided on the accessory case 10, a plurality of accessory cases may be joined together, or stackably attached to a single main case 1. Also, different accessory cases may be compartmentalized for carrying specific accessories.

Thus, according to the present invention a video camera enthusiast, for example, may utilize a main case 1 for carrying a video camera, a first accessory case 10 for personal items such as ID, a wallet, money etc., a second accessory case for an extra camera battery and/or video cassettes, a third accessory case 10 for a battery charger, and so on. Thus heavy items which may not be needed during a short excursion, such as a battery charger, may be left behind with no need for unpacking or reorganizing a camera bag and personal items may be kept conveniently separate from camera equipment.

Figure 3:
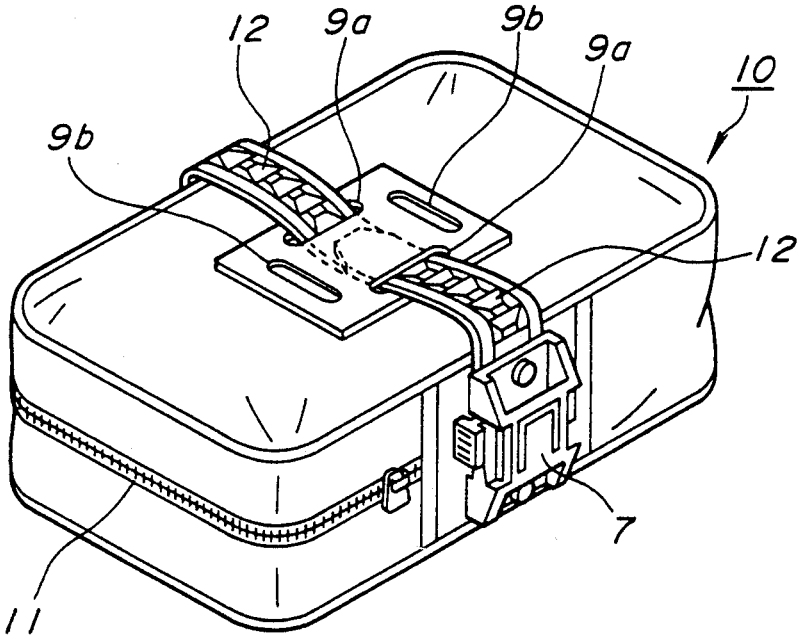
FIG. 3, is a perspective view of an accessory case according to the invention.

Furthermore, as seen in FIGS. 1 and 3, a top portion of the accessory case 10 is provided with slots 9*a*, 9*a* and 9*b*, 9*b*, the slots 9*b* being perpendicularly offset from the slots 9*a*. Thus, by this construction, when the accessory case is to be carried by separately, the projecting free ends of the linking straps 12, may be retained within one pair of slots (e.g. 9*a*, 9*a*, as shown in FIG. 3) and, the other pair of slots (9*b*, 9*b*), being perpendicularly offset from the first pair, may be utilized for insertion of the waist belt, shoulder strap, or the like, of a user for being mounted thereon for carrying.

While the present invention has been disclosed in terms of the preferred embodiment in order to facilitate better understanding thereof, it should be appreciated that the invention can be embodied in various ways without departing from the principle of the invention. For example, though the preferred embodiment describes the carrying system of the invention as employing zippers, magic tape (velcro), resealable plastic seams, or other such closing means may also be advantageously utilized. Therefore, the invention should be understood to include all possible embodiments and modifications to the shown embodiments which can be embodied without departing from the principles of the invention as set forth in the appended claims.

What is claimed is:

1. A carrying system comprising:

a main carrying case;

a plurality of accessory cases;

releasable locking means attached at mounting positions on each of the main carrying case and the accessory cases;

linking means for engaging with said releasable locking mean and positioned adjacent to the releasable locking means of each accessory case so as to extend vertically upward from said mounting position of said releasable locking means of said accessory cases;

wherein said linking means comprises at least one linking strap and;

wherein each accessory case is provided with top and bottom portions and a retaining means centered on said top portion of said accessory case, said retaining means having a first set of slots for retaining end portions of said linking strap and a second set of slots for securing one of said accessory cases via a belt when one of said accessory cases is separated from said main case and said plurality of accessory cases.

2. A carrying system as set forth in claim 1, wherein said linking strap includes ratchet teeth formed on a surface thereof.

3. A carrying system as set forth in claim 2, wherein said releasable locking means is molded as a single piece and engages said ratchet teeth formed on said linking strap.

4. A carrying system as set forth in claim 3, wherein said releasable locking means is provided with a displacable portion, a biased portion, an engaging portion associated with said biased portion, and an opening therethrough, displacement of said displacable portion causing movement of said biasing and engaging portions in a direction against the bias of said biased portion, this condition allowing introduction of said linking strap via said opening.

5. A carrying system as set forth in claim 1, wherein said main case is opened and closed via two zippers running along opposing upper side portions of said main case, respective movable portions of said two zippers being joined by a handle.

6. A carrying system as set forth in claim 1, wherein said first set of slots for retaining said end portions of said linking strap and said second set of slots for securing said accessory case are perpendicularly offset from each other.

7. A carrying system as set forth in claim 1, wherein said releasable locking means are provided on two opposing sides of said main case and each of said accessory cases respectively.

8. A carrying system as set forth in claim 7, wherein said at least one linking strap comprising a plurality of linking straps, each said linking strap being positioned adjacent to each of the releasable locking means provided on said accessory cases.

9. A carrying system as set forth in claim 1, wherein said top and bottom portions of each of said plurality of accessory cases are of substantially the same dimensions as a bottom portion of said main case.

10. A carrying system as set forth in claim 1, wherein said main case further includes an adjustable shoulder strap to facilitate carrying.

11. A carrying system for video cameras and accessories comprising: a main camera case, a first accessory case, and a second accessory case;

said main camera case being engageable with said first accessory case;

said first accessory case being engageable with said main camera case and said second accessory case;

said second accessory case being engageable with said main camera case and said first accessory case;

releasable locking means attached at mounting positions on each of the main carrying case and the first and second accessory cases for effecting said engagement;

linking means, for effecting said engagement in cooperation with said releasable locking means, said linking means being engageable with said releasable locking means and positioned adjacent to the releasable locking means of said first and second accessory cases so as to extend vertically upward from said mounting position of said releasable locking means of said first and second accessory cases;

wherein said linking means comprises at least one linking strap and;

wherein each accessory case is provided with top and bottom portions and a retaining means centered on said top portion of said accessory case, said retaining means having a first set of slots for retaining end portions of said linking strap and a second set of slots for securing one of said first and second accessory cases via a belt when one of said first and second accessory cases is separated from said main camera case and the other of said first or second accessory cases.

12. A carrying system as set forth in claim 11 wherein said linking strap includes ratchet teeth formed on a surface thereof.

13. A carrying system as set forth in claim 12, wherein said releasable locking means is molded as a single piece and engages said ratchet teeth formed on said linking strap.

14. A carrying system as set forth in claim 13, wherein said releasable locking means is provided with a displacable portion, a biased portion, an engaging portion associated with said biased portion, and an opening therethrough, displacement of said displacable portion causing movement of said biasing and engaging portions in a direction against the bias of said biased portion, this condition allowing introduction of said linking strap via said opening.

15. A carrying system as set forth in claim 11, wherein said main camera case is opened and closed via two zippers running along opposing upper side portions of said main camera case, respective movable portions of said two zippers being joined by a handle.

16. A carrying system as set forth in claim 11, wherein said first set of slots for retaining said end portions of said linking strap and said second set of slots for securing one of said first or second accessory cases are perpendicularly offset from each other.

17. A carrying system as set forth in claim 11, wherein said releasable locking means is provided on two opposing sides of said main camera case and said first and second accessory cases respectively.

18. A carrying system as set forth in claim 17, wherein said at least one linking strap comprising a plurality of linking straps, each said linking strap being positioned adjacent to each of the releasable locking means provided on said first and secondary accessory cases.

19. A carrying system as set forth in claim 11, wherein said top and bottom portions of each of said first and second accessory cases are of substantially the same dimensions as a bottom portion of said main camera case.

20. A carrying system for video cameras and accessories as set forth in claim 11, wherein each of said first and second accessory cases are provided with a zipper at an outer peripheral portion thereof.

21. A carrying system for video cameras and accessories as set forth in claim 11, wherein said first and second accessory cases are identical.

22. A carrying system for video cameras and accessories as set forth in claim 11, wherein each of said first and second accessory cases are compartmentalized differently for holding specific accessories in each one respectivelyof.

23. A carrying system as set forth in claim 11, wherein said main case further includes an adjustable shoulder strap to facilitate carrying.

* * * * *